United States Patent [19]

Romberg

[11] 3,999,591

[45] Dec. 28, 1976

[54] GATE END FOR TRACTION GATE

[76] Inventor: Felix B. Romberg, P.O. Box 218, Holland, Tex. 76534

[22] Filed: May 5, 1976

[21] Appl. No.: 683,404

[52] U.S. Cl. ..... 160/328

[51] Int. Cl.[2] ..... E06B 3/80

[58] Field of Search ..... 160/328; 49/381, 386, 49/394; 292/246, 247

[56] References Cited

UNITED STATES PATENTS

| | | | |
|---|---|---|---|
| 499,279 | 6/1893 | Bird | 160/328 |
| 3,845,804 | 11/1974 | Romberg | 160/328 |

*Primary Examiner*—Peter M. Caun

*Attorney, Agent, or Firm*—Richards, Harris and Medlock

[57] ABSTRACT

In an improved gate end for traction gates, a stub shaft is secured to the upper end of a main shaft and extends adjacent thereto. A cam following roller is supported by the stub shaft for engagement with a camming bar to apply traction at the top of the gate after a forked foot piece at the lower end of the main shaft is forced into engagement with a supporting T-bolt. A latch bolt functions to automatically secure the gate in the closed condition.

5 Claims, 12 Drawing Figures

GATE END FOR TRACTION GATE

BACKGROUND AND SUMMARY OF THE INVENTION

This invention comprises an improvement over the cam type traction gate closure described in my U.S. Pat. No. 3,845,804, granted Nov. 5, 1974. In the present invention the cam following roller is not mounted directly on the main shaft. Instead, it is mounted on a stub shaft affixed to the upper end of the main shaft with an opening between the two shafts to permit fastening of the top wire of the gate to the main shaft. The roller covers the end of the stub shaft, sheltering its bearing, and it is removable to permit galvanizing the gate end standard and for lubrication purposes.

The main shaft is offset from the stub shaft outwardly from the gate post to facilitate clasping of the main shaft during opening and closing of the gate. Thus offset, the top of the main shaft follows the underside of the camming bar to be cammed downwardly when the lower end of the gate end standard has been engaged with the T-bolt without being fully seated on the shaft thereof. The top of the main shaft also projects outwardly from under the camming bar, defining a path that intercepts a latch bolt which is movable vertically in a bracket secured to the outer side of the camming bar. This latch bolt is cammed upwardly by a beveled portion on the advancing side of the main shaft and drops down behind the trailing side of the main shaft to latch the gate end standard in traction.

DESCRIPTION OF THE DRAWINGS

For a more complete understanding of the present invention and its objects and advantages, references may now be had to the following Detailed Description when taken in conjunction with the accompanying Drawings in which.

DETAILED DESCRIPTION

Figure 1:
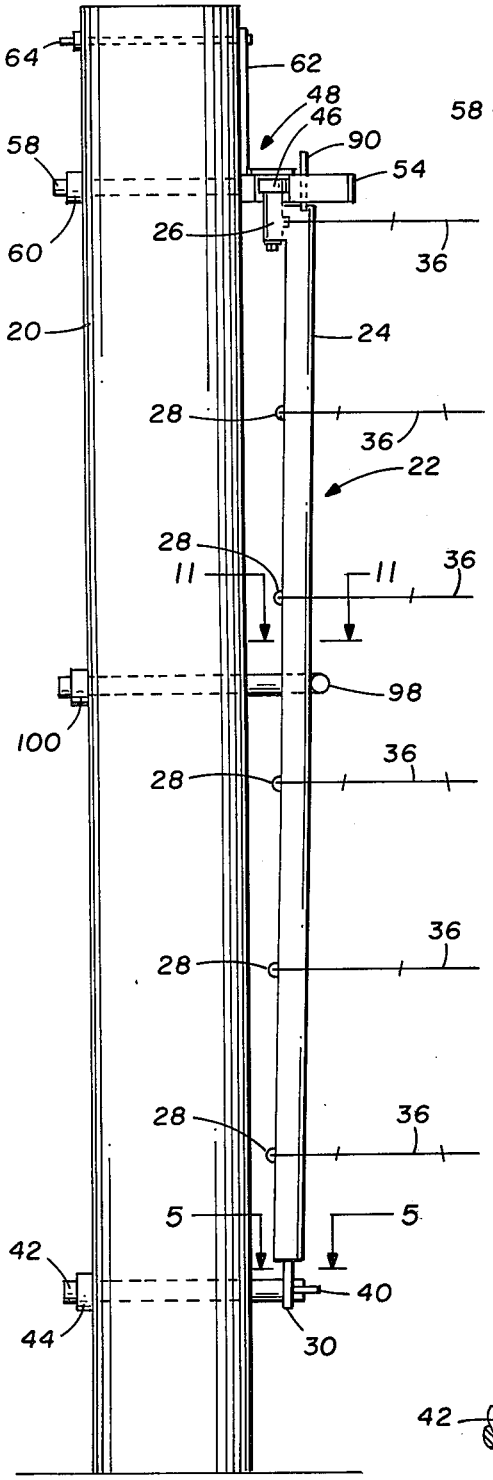
FIG. 1 is a side elevation of the latched openable gate end standard and supporting gate post, looking into the open end of the camming block.
Figure 4:
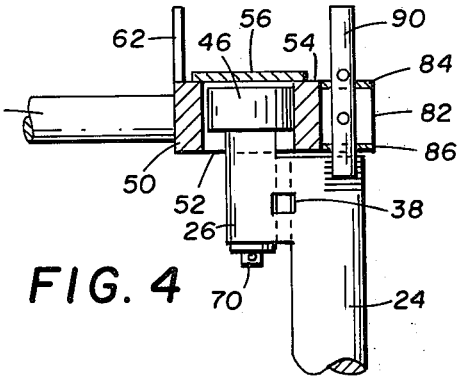
FIG. 4 is a fragmentary sectional view taken on line 4—4 of FIG. 3.
Figure 6:
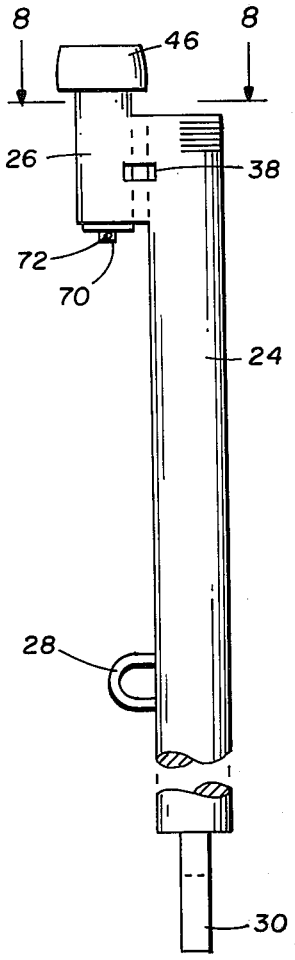
FIG. 6 is a detailed fragmentary side view of the gate end standard.
Figure 7:
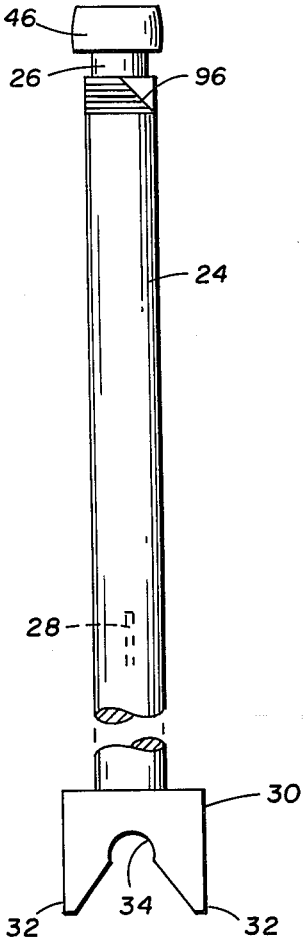
FIG. 7 is a side view similar to FIG. 6, but with the gate end standard rotated 90°.

Referring now to the Drawings, and first to FIG. 1, there is shown a gate post 20 and an openable gate end standard 22 in its latched position. As best shown in FIGS. 6 and 7, the gate end standard 22 is comprised of a main shaft 24, a stub shaft 26 affixed alongside the upper end of the main shaft, a series of arched wire retainers 28 spaced longitudinally along the same side of the main shaft as the stub shaft, and a foot piece 30 extending downwardly from the bottom of the main shaft to which it is secured by welding. The foot piece 30 has two forks 32 defining an opening between them. This opening has a semicircular upper opening 34 and widens downwardly. The forks 32 are in a plane perpendicular to the plane of the wire retainers 28 and the stub shaft 24.

Figure 5:
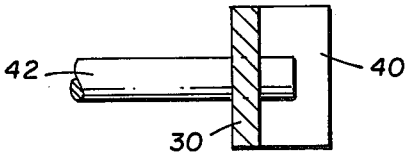
FIG. 5 is a sectional view taken on line 5—5 of FIG. 1.

A plurality of vertically spaced, parallel barbed wires 36 are fastened to the shaft 24 and are looped around it. As shown in FIG. 1, the topmost wire 36 passes through an opening 38 between the main shaft 24 and the stub shaft 26. The other wires 36 pass through the wire retainers 28. In the latched position of the gate end the tension of the wires 36 draws the forks 32 of the foot piece 30 against the flat head 40 of the T-bolt 42 (FIGS. 1 and 5) so the gate end standard stands oriented with the arched wire retainers 28 and stub shaft 26 on the side facing the gate post 20. The semicircular opening 34 receives the shank of the T-bolt which passes through the gate post and is secured by a nut 44 on the other side of the post.

The stub shaft 26 extends upward from the main shaft 24 and is topped by a cam following roller 46. In the latched gate this roller is confined in the closed end of the camming, receiving and protecting unit, or camming block, 48 (FIGS. 1, 2, 3 and 4) where it is surrounded laterally by structural segments 50, 52 and 54 which are bridged by an integral cover plate 56. Segments 50 and 52 may be made as a unit by bending a flat bar, and this unit may be joined with segment 54 comprising the camming bar by welding.

Figure 3:
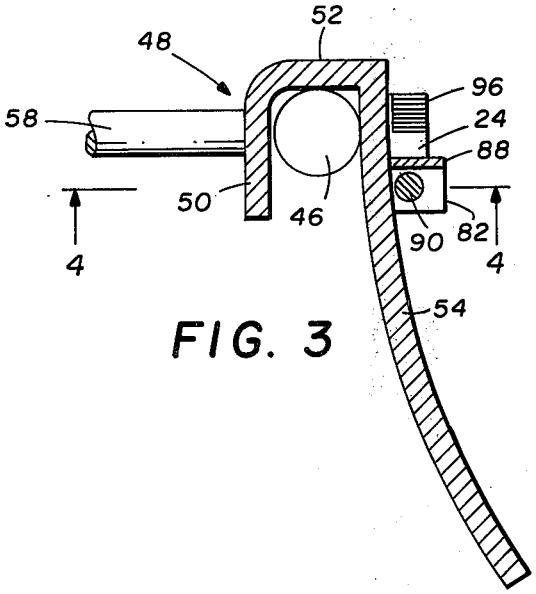
FIG. 3 is a sectional view taken along line 3—3 of FIG. 2.

An anchor bolt 58 is integral with the segment 50 and extends through the post 20, on the other side of which it is threaded and secured by a nut 60. The segments 50 and 54 are spaced to admit the roller 46 between them. When the roller 46 is in contact with the segment 52 as shown in FIG. 3, the roller axis and its point of contact with the camming bar 54 are aligned with the axis of the anchor bolt 58 while the contacted area of the camming bar 54 is substantially perpendicular to such alignment.

For maintaining the orientation of the camming block 48, a strap 62 is secured to the camming block and extends upwardly therefrom along the side of the gate post 20 to a bolt 64 which passes through a perforation 66 in the strap and through the post 20. Beyond the point opposite the anchor bolt 58 the camming bar 54 is bent outwardly with respect to the gate post 20. The camming bar 54 also extends somewhat angularly downwardly to compensate partially for the arc of the roller movement, the radius of which arc extends from the T-bolt 42 on which the gate end standard 22 is pivoted as the roller 46 follows the camming bar 54.

Figure 8:
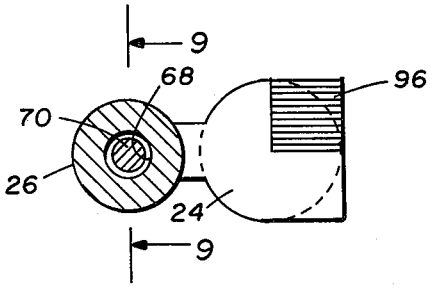
FIG. 8 is an enlarged sectional view taken along line 8—8 of FIG. 6.
Figure 9:
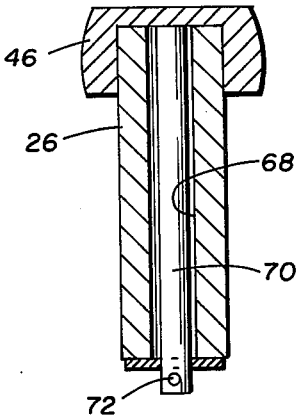
FIG. 9 is a sectional view taken along line 9—9 of FIG. 8.

As shown in FIGS. 8 and 9, the cam following roller 46 rotates about the outer side of the upper end of the stub shaft 26 and completely envelopes the upper end of the stub shaft, thereby protecting the bearing surfaces from rain and dirt when outside of the protection of the camming block 48. The stub shaft is perferably a thick walled tube. A shaft 70 is materially smaller in diameter than the bore 68 of the stub shaft and is preferably integral with the roller. The shaft 70 extends through the bore 68 from the roller to a perforation beyond the lower end of the stub shaft where a retaining pin 72 and a washer serve to hold the roller 46 from upward displacement. The periphery of the roller 46 is preferably crowned with the peak of the crown over the center of the roller engagement with the side of the stub shaft 26.

Figure 10:
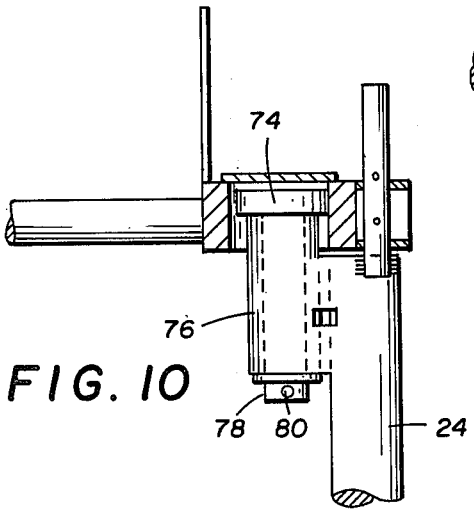
FIG. 10 is a sectional view similar to FIG. 4 but of an optional construction.

An optional cam following roller 74 and roller supporting stub shaft 76 are illustrated in FIG. 10. The stub shaft 76 has larger external and internal diameters than the stub shaft 26 and the roller 74 is integral with the upper end of a shaft 78 journaled inside the tubular stub shaft 76. The shaft 78 is perforated and secured against vertical displacement by a cross pin 80 and washer adjacent the lower end of the stub shaft 76.

Figure 2:
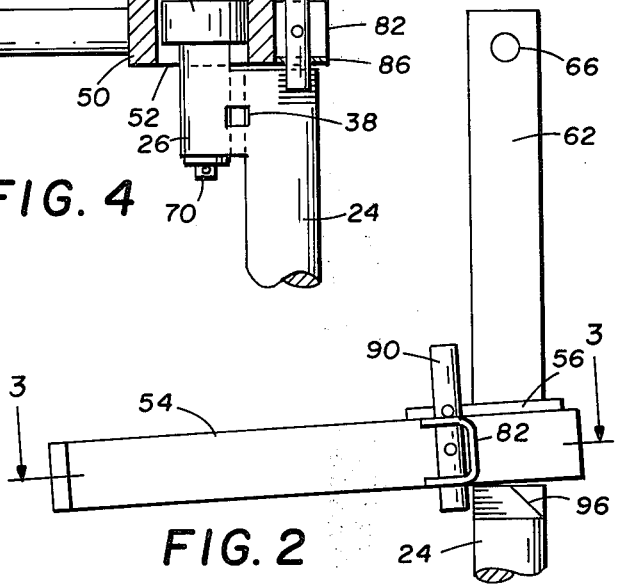
FIG. 2 is a detailed side view of the camming block and the upper end of the gate end standard, looking toward the concave side of the camming bar perpendicularly to FIG. 1.
Figure 12:
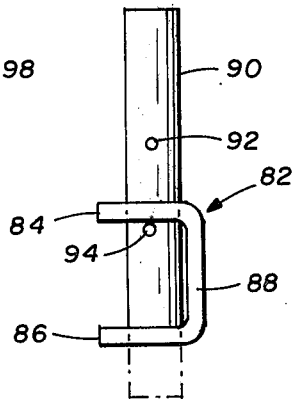
FIG. 12 is a detailed view of the latch bracket and latch pin, with the latch pin in its raised position.

As best shown in FIGS. 2, 3 and 12, a U-shaped latch bracket 82 is secured to the concave outer side of the camming bar 54 with vertically spaced horizontal flat sections 84 and 86 extending outwardly from the camming bar 54 and joined at one side by a vertical flat section 88. An upright latch bolt 90 is secured through registering openings in the spaced horizontal sections 84 and 86 for freely sliding movement therein. This latch bolt has a perforation with a cross pin 92 above the upper section 84 to limit its downward movement and has a perforation with a cross pin 94 between the horizontal sections 84 and 86 to limit upward movement of the latch bolt. After the gate end standard 22 has been latched the cross pin 94 may be removed and the latch bolt withdrawn and replaced by the shackle of a padlock.

As shown in FIGS. 2, 4, 7 and 8, the side of the main shaft 24 that is remote from the stub shaft 26 has square corners at the top and is beveled at 96 in the quadrant which first reaches the latch bolt 90 to lift the latch bolt and pass thereunder when the gate end standard 22 is moved in the direction of the latch bolt. After the shaft 24 has passed under the latch bolt, the latch bolt 90 drops to its lower position, thus automatically latching the gate end standard in traction.

Figure 11:
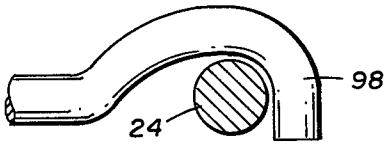
FIG. 11 is a sectional view taken on line 11—11 of FIG. 1.

To support the mid portion of the main shaft 24 against excessive bending when extra tension is transmitted to the shaft by the wires 36, a hook bolt 98 (FIGS. 1 and 11) is mounted in the post 20 with its hook open in the same direction as the camming block 48, so the shaft 24 will enter and move out of the hook as the gate is closed and opened. The hook bolt is threaded at the end opposite the hook where a nut 100 can be manipulated to place the hook the proper distance from the post for receiving the shaft 24.

In constructing a wire gate with the present openable gate end standard, the holes for bolts 42, 58 and 98 are preferably bored with the aid of a jig so that the bolts will be precisely spaced, parallel and aligned with each other and with the plane of the closed gate. The hole for the bolt 64 is bored so the main shaft 24 will just pass under the camming bar 54 when the gate end standard is seated on the shaft of the T-bolt 42. Then, whenever the forks 32 are engaged with the perpendicular end portion of the T-bolt, but without the shank of the T-bolt being fully received in the semicircular opening 34, the top of the main shaft will come into contact with the underside of the camming bar as the roller 46 follows the camming bar and will therefore be forced downwardly so the roller 46 will clear the cover plate 54 of the camming block 48.

The wires 36 are preferably stretched and fastened to the gate end standard while it is latched. Tensioning of the wires will bend the main shaft 24 and generally require longitudinal adjustment of the hook bolt 98 for free entrance of the shaft 24 thereinto.

In closing a gate constructed with the openable gate end standard 22, the lower end of the standard is first advanced and the forks 32 are hooked over the shank of the T-bolt 42. If the wires 36 are still fairly slack, gravity will bring the top of the semicircular opening 34 down to the shaft of the T-bolt 42. Otherwise, the operator will add force to accomplish this. This is followed by advancing the upper end of the gate end standard and placing the roller 46 against the convex side of the outer end of the camming bar 54 and then applying force to move the upper end beyond the latch bolt 90.

What is claimed is:

1. An openable gate end standard for a wire traction gate comprising:

a main shaft;

a pair of prongs extending longitudinally beyond one end of said main shaft and defining an outwardly widening opening between them;

a stub shaft affixed alongside the other end of said main shaft with an opening between said two shafts to accomodate a gate wire looped around said main shaft at this location;

said stub shaft extending to an end beyond the adjacent end of said main shaft; and a cam following roller rotatably mounted at said end of said stub shaft.

2. The structure according to claim 1 wherein said stub shaft has a bore extending longitudinally through it;

a shaft affixed to said roller and extending through said bore; and means beyond the end of said stub shaft opposite said roller for retaining said shaft of said roller against longitudinal displacement.

3. The structure according to claim 1 wherein a series of arched brackets are secured at longitudinal intervals along said main shaft on the same side thereof as said stub shaft for confining gate wires looped around said main shaft through said brackets.

4. The structure according to claim 1 wherein the end of said main shaft is beveled toward the common plane of the axes of said two shafts, from the outer part of one side of said main shaft.

5. For use in combination with a gate post carrying a stationary T-bolt and a stationary laterally extending camming bar longitudinally convex on the side nearest said post and longitudinally concave on the opposite side;

a latch bolt;

means for supporting said latch bolt in an upright position adjacent the concave side of said camming bar for movement up and down from below the level of the underside of said camming bar;

a gate end standard extending from a pivoted connection with said T-bolt to said camming bar;

said gate end standard including a main shaft extending to a level below the underside of said camming bar but above the lower limit of said latch bolt;

a roller for following the convex side of said camming bar;

a stub shaft carrying said roller rotatably at its upper end and connected with and offsetting said main shaft so it follows the underside of said camming bar and engages said latch bolt while said roller follows the convex side of said camming bar; and means for camming said latch bolt upwardly only when said main shaft moves against it in one direction.

* * * * *